United States Patent [19]

Bisceglia

[11] Patent Number: 4,979,926

[45] Date of Patent: Dec. 25, 1990

[54] TOY EXPLODING BRIDGE APPARATUS

[76] Inventor: Stephen D. Bisceglia, 70 West Street #A-17, Harrison, N.Y. 10528

[21] Appl. No.: 530,153

[22] Filed: May 29, 1990

[51] Int. Cl.[5] ..... A63H 33/00; A63F 9/14

[52] U.S. Cl. ..... 446/476; 446/4

[58] Field of Search ..... 446/476, 444, 478, 4

[56] References Cited

U.S. PATENT DOCUMENTS

| | | | |
|---|---|---|---|
| 2,442,526 | 6/1948 | Wright | 446/4 |
| 2,457,653 | 12/1948 | Froelich | 446/4 |
| 2,927,396 | 3/1960 | Hall | 446/476 |
| 3,564,756 | 2/1971 | Yokoi | 446/4 |
| 4,661,080 | 4/1987 | Goldstein | 446/4 |

FOREIGN PATENT DOCUMENTS

| | | | |
|---|---|---|---|
| 1074 | 3/1915 | United Kingdom | 446/4 |
| 8133 | 1/1916 | United Kingdom | 446/4 |

*Primary Examiner*—Richard J. Johnson

*Attorney, Agent, or Firm*—Leon Gilden

[57] ABSTRACT

An apparatus including a forward ramp member spaced from a rear ramp member, with a medial support member positioned therebetween, and a first and second platform plate member secured between the medial support and the forward and rear ramp members, wherein the medial support includes a piston mounted within the support in a retracted first position and directed exteriorly thereof to impact medially of the platform members in a second position to effect a disassembly of the bridge structure and associated side rails mounted upon the forward and rear ramp members and the platform plate members.

7 Claims, 4 Drawing Sheets

PRIOR ART

TOY EXPLODING BRIDGE APPARATUS

BACKGROUND OF THE INVENTION

1. Field of the Invention

The field of invention relates to toy structure, and more particularly pertains to a new and improved toy exploding bridge apparatus wherein the same permits selective disassembly of a toy bridge structure to simulate an explosive disassembly.

2. Description of the Prior Art

Toy structure for amusement and entertainment of children and the like has been provided in the prior art. Particularly in action type toys, it is desirable to enhance the enjoyment and entertainment value of such toys by an organization to simulate an accident and enhance excitement in use of the toy. The present invention increases the interest and fascination of a road course type toy arrangement by simulating an explosion by the impulse disassembly of a bridge-type structure. Prior art patent structure may be found in U.S. Pat. No. 4,661,080 to Goldstein, et al. wherein a toy bridge includes a device to project a toy vehicle therefrom to simulate an explosion of the vehicle relative to the bridge structure.

U.S. Pat. No. 2,442,526 to Wright sets forth a toy bridge structure wherein the bridge structure simulates a disassembly by the components disassociating themselves from one another in a progressive manner.

U.S. Pat. No. 4,575,346 to Ogawa wherein a magnetic path includes a jumping portion for a magnetic traversing toy to overcome.

U.S. Pat. No. 2,457,653 to Froelich sets forth a toy wherein an underlying platform permits disassembly of toy components mounted thereon upon impacting of the toy assembly by an underlying plate member.

U.S. Pat. No. 1,253,771 to Dettra sets forth a toy boat structure wherein the boat structure is disassembled upon impact with a further boat-type structure.

As such, it may be appreciated that there continues to be a need for a new and improved toy exploding bridge apparatus wherein the same permits instantaneous disassembly of a toy bridge to simulate explosion and in this respect, the present invention substantially fulfills this need.

SUMMARY OF THE INVENTION

In view of the foregoing disadvantages inherent in the known types of toy bridge structures now present in the prior art, the present invention provides a toy exploding bridge apparatus wherein the same includes a projectable piston to effect immediate and simultaneous disassembly of the bridge structure. As such, the general purpose of the present invention, which will be described subsequently in greater detail, is to provide a new and improved toy exploding bridge apparatus which has all the advantages of the prior art toy bridge organizations and none of the disadvantages.

To attain this, the present invention provides an apparatus including a forward ramp member spaced from a rear ramp member, with a medial support member positioned therebetween, and a first and second platform plate member secured between the medial support and the forward and rear ramp members, wherein the medial support includes a piston mounted within the support in a retracted first position and directed exteriorly thereof to impact medially of the platform members in a second position to effect a disassembly of the bridge structure and associated side rails mounted upon the forward and rear ramp members and the platform plate members.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toy exploding bridge apparatus which has all the advantages of the prior art toy bridge organizations and none of the disadvantages.

It is another object of the present invention to provide a new and improved toy exploding bridge apparatus which may be easily and efficiently manufactured and marketed.

It is a further object of the present invention to provide a new and improved toy exploding bridge apparatus which is of a durable and reliable construction.

An even further object of the present invention is to provide a new and improved toy exploding bridge apparatus which is susceptible of a low cost of manufacture with regard to both materials and labor, and which accordingly is then susceptible of low prices of sale to the consuming public, thereby making such toy exploding bridge apparatus economically available to the buying public.

Still yet another object of the present invention is to provide a new and improved toy exploding bridge apparatus which provides in the apparatuses and methods of the prior art some of the advantages thereof, while simultaneously overcoming some of the disadvantages normally associated therewith.

Still another object of the present invention is to provide a new and improved toy exploding bridge apparatus wherein the same includes a projectile piston to effect simultaneous and explosive disassembly of a toy bridge structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
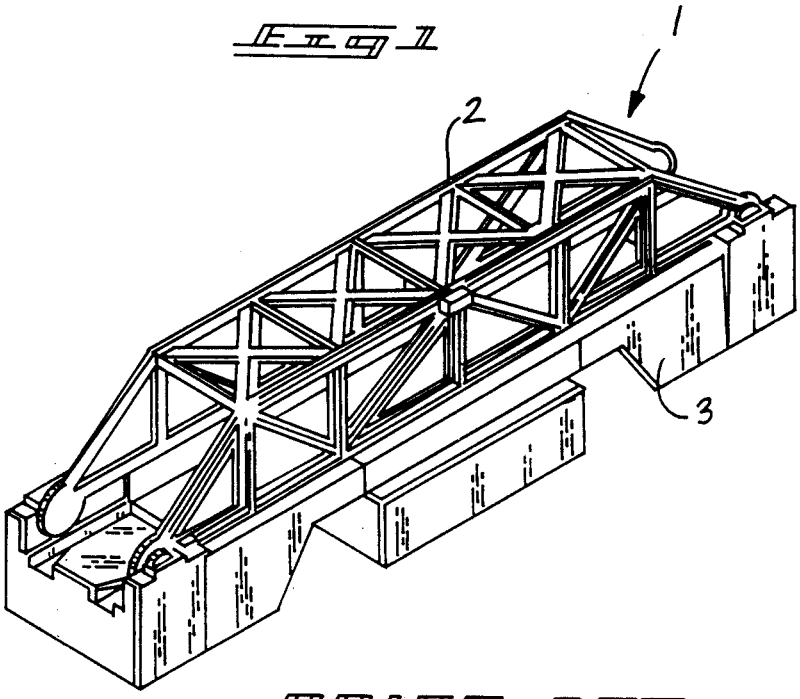
FIG. 1 is an isometric illustration of a prior art toy bridge structure.

With reference now to the drawings, and in particular to FIGS. 1 to 8 thereof, a new and improved toy exploding bridge apparatus embodying the principles and concepts of the present invention and generally designated by the reference numeral 10 will be described.

Figure 2:
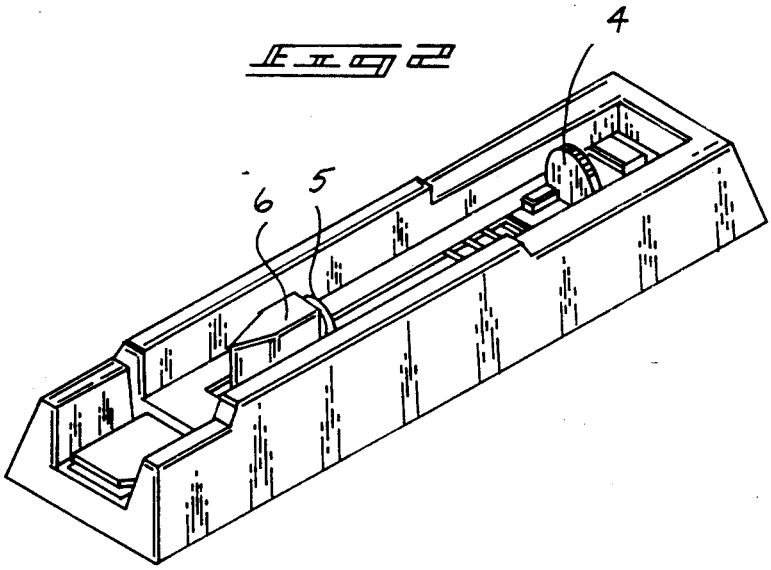
PRIOR ART Fig 2
FIG. 2 is an isometric illustration of the toy bridge structure as set forth in FIG. 1, illustrating the various internal components thereof.

FIG. 1 illustrates a prior art bridge structure utilizing an integral super structure 2 and underlying support apparatus 3, with a launching device, as illustrated in FIG. 2, utilizing an impeller 6 slidable within the groove within the floor of the launching device cooperating with a bellows 5 and a selector 4 to vary the force and relative positioning of the impeller 6 in its rearward position within the launching device, as illustrated in FIG. 2 and as set forth in U.S. Pat. No. 4,661,080.

Figure 3:
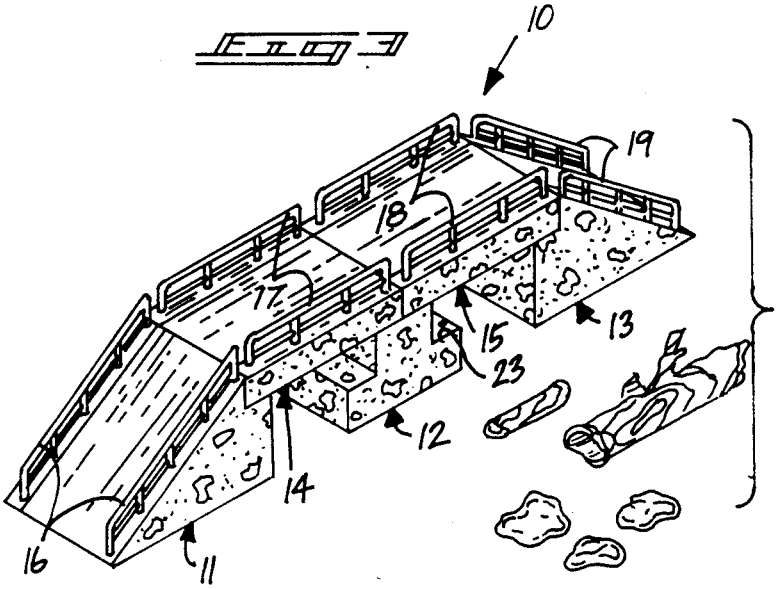
FIG. 3 is an isometric illustration of the instant invention.
Figure 4:
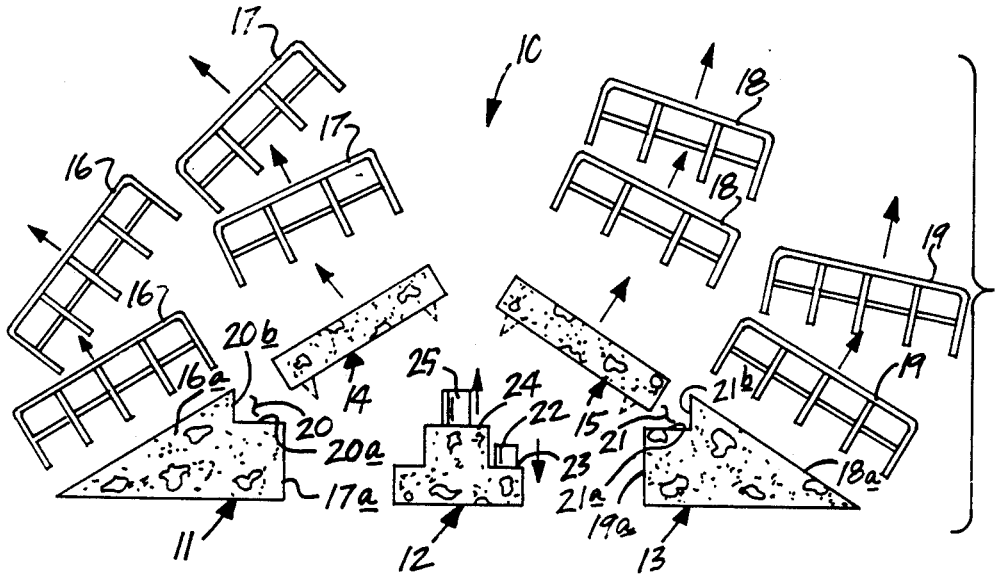
FIG. 4 is an isometric exploded illustration of the instant invention.

More specifically, the toy exploding bridge apparatus 10 of the instant invention essentially comprises a forward ramp member 11 spaced from a rear ramp member 13 and longitudinally aligned therewith, including a "T" shaped actuator support 12 positioned medially between the forward and rear ramp members 11 and 13 respectively. A first bridge plate 14 overlies the forward ramp member 11 and an upper planar surface 24 of the "T" shaped actuator support 12, with a second bridge platform plate 15 overlying the upper planar surface 24 of the actuator support 12 and the rear ramp member 13. The forward ramp member 11 includes a first inclined surface **16*a* and a first rear vertical wall 17*a*, wherein similarly the rear ramp member 13 defined by a like configuration of the forward ramp member 11 includes a second inclined surface 18*a* and a second rear vertical wall 19*a*, with the first and second rear vertical walls 17*a* and 19*a* positioned in a parallel and confronting relationship, as illustrated in FIG. 3 and FIG. 4 for example, with the "T" shaped actuator support 12 positioned medially thereof. A first elongate recess 20 is formed at the intersection of the first rear inclined surface 16*a* and the first rear vertical wall 17*a* and is defined by a first horizontal surface 20*a* and a first vertical surface 20*b*. Similarly, a second elongate recess 21 is defined by an intersection between the second inclined surface 18*a* and the second rear vertical wall 19*a* of the rear ramp member 13 and is defined by a second horizontal surface 21*a* and a second vertical surface 21*b*, with the first and second horizontal surfaces 20*a* and 21*a* and the upper planar surface 24 of the "T" shaped actuator support 12** in a planar alignment relative to one another.

Figure 6:
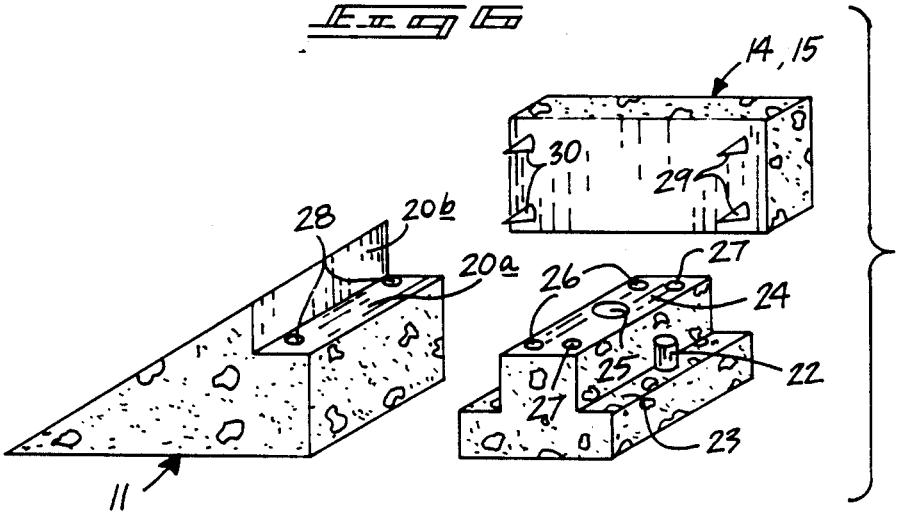
FIG. 6 is an isometric illustration of the association of the ramp member and actuator support organization.

In a first position, a forward edge of the first bridge platform plate 14 is received within the first elongate recess 20 overlying the first horizontal surface **20*a* in abutment with the first vertical surface 20*b*, with a rear end portion of the first bridge platform plate 14 positioned medially and bisecting the upper planar surface 24 of the acutator support 12. A forward portion of the second bridge platform plate 15 medially overlies the upper planar surface 24 in abutment with the rear end portion of the first bridge platform plate 14, with a rear end portion of the second bridge platform plate 15 received within the second elongate recess 21 positioned on the second horizontal surface 21*a* in abutment with the second vertical surface 21*b*, in a manner as illustrated in FIG. 3 for example. To assist in positioning of the bridge platform plates 14 and 15, the plates are optionally formed with downwardly projecting forward and rear conical projections 30 and 29 respectively to be received within complementary conical recesses within the actuator support 12 and the ramp members 11 and 13. As illustrated in FIG. 6, the upper planar surface 24 includes a first conical recess pair 26 and a third conical recess pair 28 to receive the rear and forward conical projections 29 and 30 respectively therewithin. Similarly, a second recess pair 27 parallel to and spaced from the first conical recess pair 26 are positioned on the upper planar surface 24 to receive a forward conical projection 30 of the second bridge platform plate 15, wherein a similar positioning of a third conical recess pair 28 through the second horizontal surface 21*b* receives the rear conical projections 29 of the second bridge platform plate 15 (not shown) of a duplicate configuration to that as illustrated in FIG. 6**.

Figure 5:
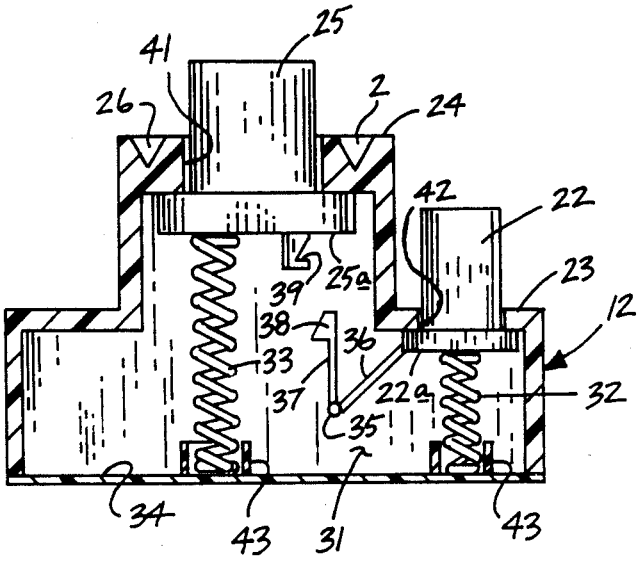
FIG. 5 is a cross-sectional illustration of the "T" shaped actuator support of the instant invention.
Figure 7:
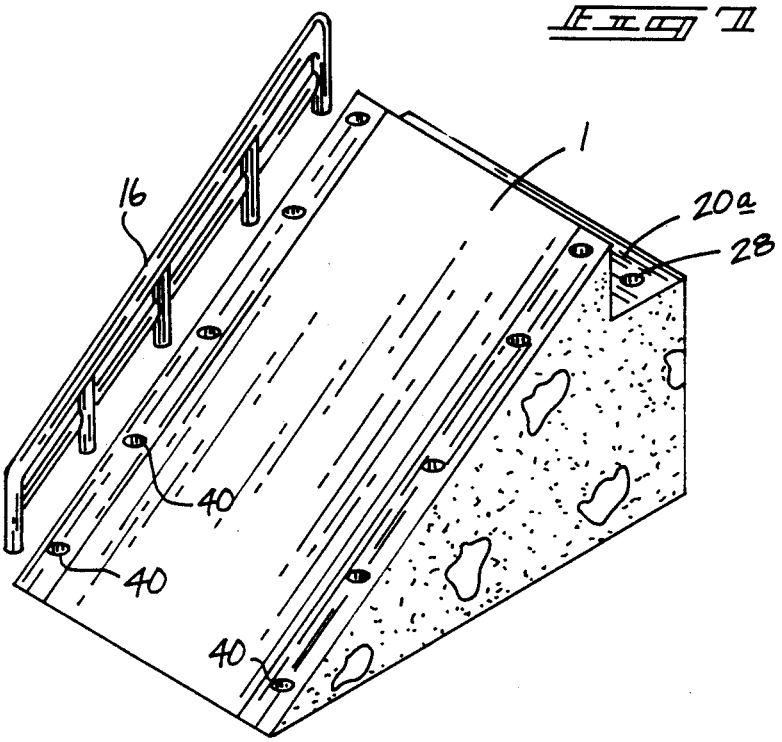
FIG. 7 is an isometric illustration of a ramp member of the instant invention.
Figure 8:
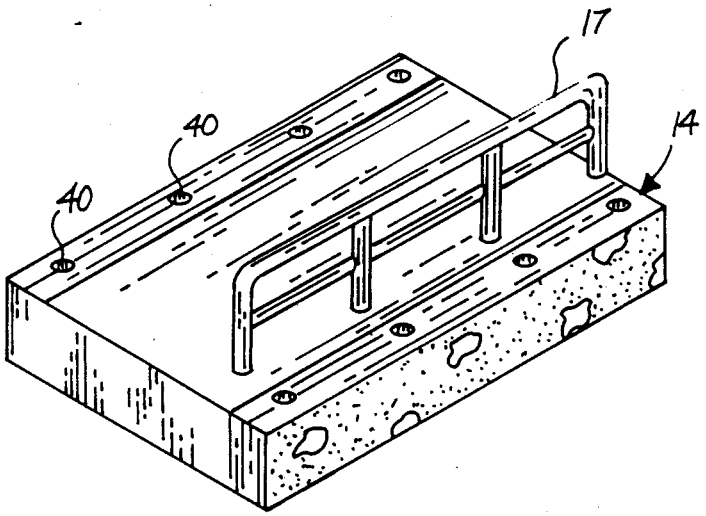
FIG. 8 is an isometric illustration of a bridge platform plate utilized by the instant invention.

An ejector piston 25 is positioned reciprocatably through the upper planar surface 24 and is orthogonally aligned thereto to project to a second position, as illustrated in FIG. 5, from the first position, as illustrated in FIG. 6. The ejector piston 25 (see FIG. 5) includes an ejector piston cap **25*a* defined by an ejector piston cap diameter greater than an upper surface bore diameter defined by the upper surface bore 41 through which the ejector piston 25 reciprocates to limit projection of the ejector piston 25 through the upper planar surface 24. The ejector piston 25 is biased in the extended or second position by a piston spring 33, and wherein the ejector piston cap 25*a* includes a support recess 39 mounted within a boss projecting orthogonally downwardly from the ejector piston cap 25. A plunger 22 is mounted through a lower planar surface 23 of the "T" shaped actuator support 12 and a plunger cap 22*a* is defined by a plunger cap diameter greater than a lower surface bore 42 defined through the lower planar surface 23 to limit projection of the plunger 22 above the lower planar surface 23, as illustrated, with a plunger spring 32 normally biasing the plunger in an extended plunger first position, as illustrated in FIG. 5. A first link 36 is mounted to the plunger cap 22a and pivots about a pivot axle 35, with a second link 37 fixedly mounted to the first link 36, whereupon downward projection of the plunger 22 to a second position pivots the second link 37 about the pivot axle 35, whereupon a projection finger 38 fixedly mounted to an upper terminal end of the second link 37 is removed from the support recess 39 of the boss to permit the ejector piston 25 to project upwardly, as illustrated in FIG. 5, and thereby effect explosive disassembly of the organization, as illustrated in FIG. 4. It should also be noted to enhance an effect of the explosive force, a first pair of rails 16 is mounted on the first inclined surface 16a at the side edges thereof, with a second and third pair of rails 17 and 18 mounted to an upper surface of the first and second bridge platform plates 14 and 15 respectively, wherein a fourth pair of rails 19 are mounted to the second inclined surface 18a, with each of the rails including leg members receivable within associated rail apertures 40**, in a manner as illustrated in FIGS. 7 and 8.

It should be noted that the support floor 34 of the "T" shaped actuator support 12 within the support cavity 31 each include spring wells 43 to capture lower terminal ends of the plunger spring 32 and the piston spring 33 and maintain alignment of the springs relative to the ejector piston 25 and the plunger 22.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters patent of the United States is as follows:

1. A toy exploding bridge apparatus comprising, in combination, a forward ramp member, including a first inclined surface and a first rear vertical wall surface, and a rear ramp member, including a second inclined surface and a second rear vertical wall, wherein the first and second rear vertical walls are arranged parallel to one another and in confronting relationship, and an actuator support positioned medially of the forward and rear ramp members, and a first bridge platform plate positioned on the forward ramp member and the actuator support spanning a gap between the forward ramp member and the actuator support, and a second bridge platform plate overlying the actuator support and the rear ramp member, with the first and second bridge platform plates aligned relative to one another and in abutment in a first position, and piston means mounted within the actuator support underlying the first and second bridge platform plates in a first position, and the piston means extensible to a second position for immediate disassembly of the first and second bridge platform plates relative to the forward and rear ramp members and a "T" shaped actuator support.

2. An apparatus as set forth in claim 1 wherein the forward ramp member includes a first elongate recess formed at an intersection defined by the first inclined surface and the first rear wall, and a second elongate recess formed within a rear ramp member at a further intersection defined by the second inclined surface and the second rear vertical wall, and the first elongate recess including a first horizontal surface and a first vertical surface, and the second elongate recesses including a second horizontal surface and a second vertical surface, and a forward end of the first bridge plate member overlying the first horizontal surface and in abutment with the first vertical surface, and a rear end portion of the first bridge platform plate overlying the piston means formed within the actuator support, and a forward end of the second bridge platform plate overlying the piston means formed within the actuator support at a forward end of the first bridge plate member, and a rear end portion of the second bridge platform plate overlying the second horizontal surface and in abutment with the second vertical surface in a first position.

3. An apparatus as set forth in claim 2 wherein the actuator support includes a lower planar surface spaced from an upper planar surface, and the piston means reciprocable through the upper planar surface, and the upper planar surface in planar alignment with the first horizontal surface and the second horizontal surface.

4. An apparatus as set forth in claim 3 wherein the lower planar surface includes a plunger reciprocable therethrough, the plunger including a first link mounted to the plunger, the first link including a pivot axle mounted to the first link space from the plunger, and the first link including a second link fixedly mounted to the first link, with the second link including a projection finger, and the projection finger securable within a support boss, the support boss including a support recess to secure the projection finger thereon in the first position, and the support boss fixedly mounted to a bottom surface of the ejector piston.

5. An apparatus as set forth in claim 4 wherein the ejector piston includes a piston spring biasing the ejector piston in a second extended position, wherein the piston spring is mounted within a spring well, and the spring well is mounted on a support floor within a cavity defined by the actuator support, and the plunger includes a plunger spring mounted within a further well, and the further well mounted on the support floor to bias the plunger in an extended position relative to the lower planar surface.

6. An apparatus as set forth in claim 5 wherein the first bridge platform plate includes a first pair of conical projections extending orthogonally through a bottom surface of the first bridge platform plate and receivable within conical cavities formed within the first horizontal surface, and further conical projections directed orthogonally from the bottom surface of the first bridge platform plate adjacent the rear terminal end portion of the first bridge platform plate and receivable within conical recesses formed within the upper planar surface of the actuator support, and a further plurality of conical recesses formed within the upper planar surface of the actuator support to receive a further pair of conical projections formed orthogonally to a bottom surface of the second bridge platform plate, and the second bridge platform plate including a yet further plurality of conical projections directed orthogonally from the bottom surface of the second bridge platform plate adjacent the rear terminal end portion of the second bridge platform plate for reception within conical recesses formed through the second vertical surface of the second elongate recess.

7. An apparatus as set forth in claim 6 wherein the first inclined surface includes a plurality of first side rails separably mounted to the first inclined surface, and the first bridge platform plate includes a second plurality of rails mounted separably to the first bridge platform plate, and a third plurality of rails mounted to the second bridge platform plate separably thereto, and a fourth plurality of rails mounted to the second inclined surface separably thereto, where each of the rails are separated during extension of the ejector piston to the second or extended position.

* * * * *